US009046091B2

(12) United States Patent
Tanaka

(10) Patent No.: US 9,046,091 B2
(45) Date of Patent: Jun. 2, 2015

(54) CRYOPUMP

(75) Inventor: Hidekazu Tanaka, Saitama (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 1254 days.

(21) Appl. No.: 12/585,921

(22) Filed: Sep. 29, 2009

(65) Prior Publication Data

US 2010/0077771 A1 Apr. 1, 2010

(30) Foreign Application Priority Data

Oct. 1, 2008 (JP) ..... 2008-256514

(51) Int. Cl.
*B01D 8/00* (2006.01)
*F04B 37/06* (2006.01)
*F04B 37/08* (2006.01)

(52) U.S. Cl.
CPC ..... *F04B 37/06* (2013.01); *F04B 37/08* (2013.01); *F04B 37/085* (2013.01)

(58) Field of Classification Search
CPC ..... F04B 37/085; F04B 37/08; F04B 37/00; F04B 37/02; F04B 37/04; F04B 37/06; B01D 8/00
USPC ..... 62/6; 417/901
See application file for complete search history.

(56) References Cited

U.S. PATENT DOCUMENTS 4,285,710 A * 8/1981 Welch ..... 62/55.5
4,736,591 A * 4/1988 Amos et al. ..... 62/55.5
4,763,483 A * 8/1988 Olsen ..... 62/55.5
4,896,511 A * 1/1990 Lessard et al. ..... 62/55.5
5,154,063 A * 10/1992 Nagao et al. ..... 62/55.5
5,231,840 A * 8/1993 Yagi et al. ..... 62/55.5
5,333,466 A * 8/1994 Harrington et al. ..... 62/55.5
8,316,651 B2 * 11/2012 Schlenga et al. ..... 62/51.1

FOREIGN PATENT DOCUMENTS

JP 62-004405 A 1/1987
JP 03-023386 A 1/1991
JP 10-054356 A 2/1998
JP 10054356 A * 2/1998

OTHER PUBLICATIONS

Office Action issued in corresponding Japanese Application No. 2008-256514, dated Aug. 21, 2012.

* cited by examiner

*Primary Examiner* — John F Pettitt
*Assistant Examiner* — Ana Vazquez
(74) *Attorney, Agent, or Firm* — Fishman Stewart Yamaguchi PLLC

(57) ABSTRACT

A cryopump includes a second-stage cryopanel, a radiation shield that surrounds the second-stage cryopanel and has a shield opening, and a first-stage cryopanel provided in the shield opening. The first-stage cryopanel includes a first panel provided with opening regions thereon in a first distribution, and a second panel arranged closer to the second-stage cryopanel than the first panel and provided with opening regions thereon in a second distribution different from the first distribution when viewed in an arrangement direction of the first and second panels.

9 Claims, 2 Drawing Sheets

CRYOPUMP

BACKGROUND OF THE INVENTION

1. Field of the Invention

The present invention relates to a cryopump.

2. Description of the Related Art

A cryopump is a vacuum pump that captures and pumps gas molecules by condensing or adsorbing molecules on a cryopanel cooled to an extremely low temperature. The cryopumps is generally used to achieve a clean vacuum environment required in a semiconductor circuit manufacturing process or the like.

For example, Japanese Patent Application Publication No. Hei 3-23386 discloses a cryopump in which a baffle is provided in an opening portion of a radiation heat shield panel surrounding a second panel. The baffle is structured by a first baffle and a second baffle. Each of the first and the second baffles is formed into the same structure with each other by louvers that incline upwards/downwards. Each louver is fixed to the opening portion of the shield panel such that the outer circumferential portion thereof faces the adjacent louver in the upward-downward direction.

Because the aforementioned cryopump is provided such that the louvers face each other in the upward-downward direction in each of the first and the second baffles, each of the first and the second baffles optically occludes the inside of the cryopump. That is, when viewing from outside the first baffle in the central axis direction of the cryopump, the inside of the pump cannot be seen through the first baffle. The same is true with respect to the second baffle. According to this structure, entry of radiation heat from outside can be suppressed; however, gas molecules to be pumped by the second panel are difficult to pass through the baffle. Flow resistance of a gas is further increased due to installation of the second baffle in addition to the first baffle, causing an pumping speed of the cryopump to be small in addition to heat input.

SUMMARY OF THE INVENTION

In view of such circumstances, a purpose of the present invention is to provide a cryopump in which both a reduced influence of the radiation heat and an improved pumping speed of the cryopump can be realized.

In an embodiment of the present invention, there is provided a cryopump having: a second-stage cryopanel; a radiation shield that surrounds the second-stage cryopanel and has a shield opening; and a first-stage cryopanel provided in the shield opening. The first-stage cryopanel includes a first panel provided with opening regions thereon in a first distribution, and a second panel arranged closer to the second-stage cryopanel than the first panel and provided with opening regions thereon in a second distribution different from the first distribution when viewed in an arrangement direction of the first and second panels.

According to the embodiment, the first-stage cryopanel has a double layer panel structure, each layer of which has an opening region distribution different from each other. With this, the radiation heat having passed through the opening region of one of the panels is absorbed or reflected by the other panel. Accordingly, the radiation heat to enter the inside of the cryopump can be reduced. Further, because each panel has the opening region and is optically open, a flow resistance of a gas is relatively small. Therefore, it becomes possible that both a reduced influence of the radiation heat and an improved pumping speed of the cryopump are realized.

In another embodiment of the present invention, there is provided a cryopump having: a second-stage cryopanel structure; and a first-stage cryopanel structure that is cooled to a temperature higher than that of the second-stage cryopanel structure and is arranged in front of the second-stage cryopanel structure. The first-stage cryopanel structure may include a double structure having an outer panel and an inner panel, so that a gas molecule having passed through the outer panel takes a path in which the gas molecule is reflected by the inner panel and subsequently reflected by the outer panel to enter into the cryopump.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
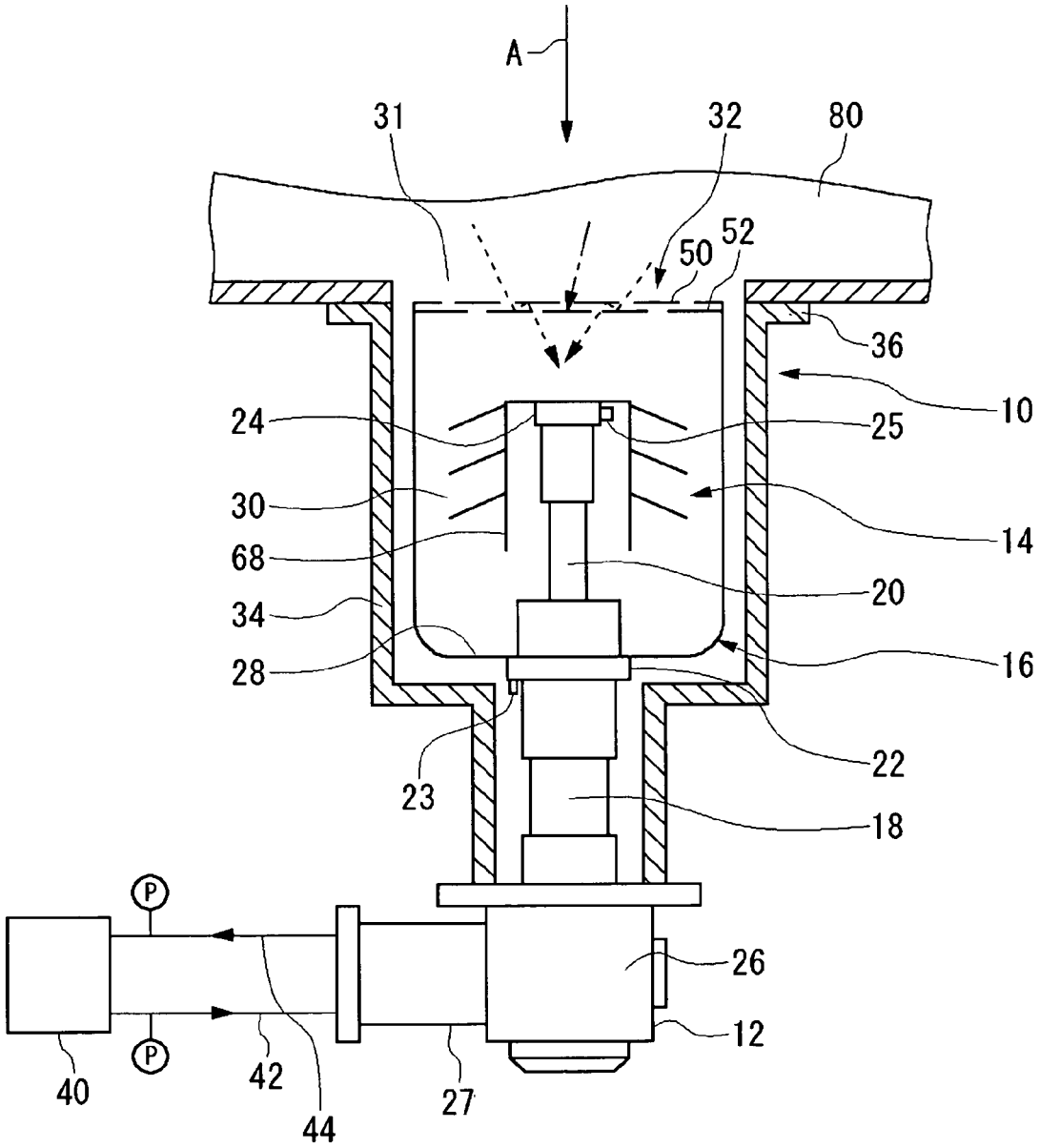
FIG. 1 is a cross-sectional view schematically illustrating a cryopump according to an embodiment of the present invention.

The invention will now be described by reference to the preferred embodiments. This does not intend to limit the scope of the present invention, but to exemplify the invention. A cryopump according to an embodiment of the present invention comprises a first-stage cryopanel having a double layer panel structure. The first-stage cryopanel may comprise: a first panel, an opening region of which is formed in a first distribution; and a second panel arranged inside the first panel when viewed in the central axis direction of the cryopump, an opening region of which is formed in a second distribution different from the first distribution. The first-stage cryopanel is installed in, for example, a shield opening. Many through-holes may be formed in the first distribution in the first panel, while many through-holes may be formed in the second distribution in the second panel. The first panel and the second panel may be arranged such that each opening region thereof does not overlap with each other, when viewed in the central axis of the pump. A plurality of opening regions may be formed in the second panel in an arrangement in which at least part of the plurality of opening regions does not overlap the opening region of the first panel, when viewed in the panel arrangement direction.

The opening region and a shielding region may be formed in the cryopanel. The opening region of the panel is an area for passing through gas molecules in a non-contact manner with the panel, the opening region typically being formed into an opening or a through-hole. Alternatively, a space between the cryopanel and the radiation shield can be considered the opening region. The shielding region of the panel is an area for reflecting or capturing gas molecules to prevent them from passing through.

For example, the shielding region of the second panel may be provided below the opening region of the first panel, while the shielding region of the first panel be provided above the opening region of the second panel. The first and the second panels may be arranged such that the opening region of the first panel is encompassed by the shielding region of the second panel, when viewed in the arrangement direction of the first and the second panels. In this case, in the second panel, the opening region may be formed around the shielding region. The opening region of the second panel may be formed below the shielding region of the first panel, the shielding region being formed between a plurality of opening regions adjacent to each other.

The first-stage cryopanel may include a plurality of individual panels arranged in front of the second-stage cryopump, each of the individual panels being optically open. The first-stage cryopanel may be optically closed as a whole, when viewed in the arrangement direction of the individual panels. As a result, the first-stage cryopanel shields the second-stage cryopump from the radiation heat. On the other hand, because each of the individual panels is optically open, the flow resistance of a gas is relatively small. Therefore, it becomes possible that both a reduced influence of the radiation heat and an improved pumping speed of the cryopump are realized.

Further, a cryopump according to an embodiment may comprise a first-stage cryopanel structure including a double layer structure structured by a first and a second panels, so that gas molecules having passed through the first panel reaches the inside of the pump through an approach path in which the gas molecules reach there by being reflected by the first panel after being reflected by the second panel. The first-stage cryopanel structure may be structured such that gas molecules having entered the inside of the panel structure reach the inside of the cryopump through an approach path in which the gas molecules reach there by being reflected by a panel provided relatively outside after being reflected by a panel provided relatively inside. The first-stage cryopanel structure may be structured such that gas molecules, an angle between the central axis direction of the cryopump and an approaching direction of which is less than or equal to a predetermined angle, reach the inside of the pump by being reflected by the outer panel after being reflected by the inner panel.

The radiation heat linearly enters the first-stage cryopanel structure in the same way as the gas molecules. Inside a vacuum chamber of, for example, a sputtering apparatus in which the cryopump is installed, a heat source (for example, a plasma source or a chamber sidewall) is present. The radiation heat having entered the first-stage cryopanel structure is absorbed or reflected by the inner panel or the outer panel. Accordingly, heat input toward the inside of the pump is reduced. Because the first-stage cryopanel structure is configured such that the gas molecules are reflected approximately two times by the first-stage cryopanel structure, it is relatively easy to guide a gas to be pumped by the second-stage cryopanel to the inside of the pump. Therefore, both reduction of the influence caused by the radiation heat and the pumping speed of the cryopump can be realized.

A radiation factor (also referred to as an emissivity) of the inner panel surface may be higher than that of the outer panel surface. Alternatively, the radiation factor of at least back surface of the outer panel (i.e., the surface facing the inner panel) may be higher, instead of or in conjunction with the radiation factor of the inner panel surface being higher. Still alternatively, the radiation factor of a portion of the inner panel surface, the portion being exposed by the opening region of the outer panel, may be higher. In this case, the radiation factor with respect to a radiation energy at least in the infrared territory, may be higher. In order to increase the radiation factor, for example, a black-body treatment may be applied to the surface. The radiation heat can be efficiently absorbed by increasing the radiation factor of a portion inside the first cryopanel structure where the radiation heat possibly reaches, allowing entry of the radiation heat into the inside of the cryopump to be mitigated.

FIG. 1 is a cross-sectional view schematically illustrating a cryopump 10 according to an embodiment of the present invention. The cryopump 10 is mounted in a vacuum chamber 80 in an apparatus, such as an ion implantation apparatus and a sputtering apparatus. The cryopump 10 is used to enhance the degree of vacuum in the vacuum chamber 80 to a level required in a requested process. For example, the cryopump 10 achieves a high degree of vacuum of about $10^{-5}$ Pa or about $10^{-8}$ Pa.

The cryopump 10 comprises a refrigerator 12, a second-stage cryopanel 14, a radiation shield 16 and a first-stage cryopanel structure 32. The second-stage cryopanel 14 includes a plurality of cryopanels, which are cooled by the refrigerator 12. A cryogenic temperature surface for capturing a gas by condensation or adsorption so as to pump the gas, is formed on the panel surface. The surface (e.g., back surface) of the cryopanel is normally provided with an adsorbent such as activated carbon or the like in order to adsorb a gas. The first-stage cryopanel structure 32 is fixed to the radiation shield 16 at a shield opening 31. Hereinafter, the first-stage cryopanel structure 32 is sometimes and simply called a first-stage panel 32.

The cryopump 10 is provided with a first cryopanel cooled to a first cooling temperature level and a second cryopanel cooled to a second cooling temperature level lower than the first cooling temperature level. The first cryopanel condenses and captures a gas having a low vapor pressure at the first cooling temperature level so as to pump the gas accordingly. For example, the first cryopanel pumps a gas having a vapor pressure lower than a reference vapor pressure (e.g., $10^{-8}$ Pa). The second cryopanel condenses and captures a gas having a low vapor pressure at the second cooling temperature level so as to pump the gas accordingly. In order to capture a non-condensable gas that cannot be condensed at the second temperature level due to a high vapor pressure, an adsorption area is formed on the surface of the second cryopanel. The adsorption area is formed by, for example, providing an adsorbent on the panel surface. The non-condensable gas is adsorbed by the adsorption area cooled to the second temperature level and pumped. The first cryopanel includes, for example, the radiation shield 16 and the first-stage cryopanel 32, while the second cryopanel includes, for example, the second-stage cryopanel 14.

The cryopump 10 is a so-called vertical-type cryopump, where the refrigerator 12 is inserted and arranged along the central axis of the radiation shield 16. The present invention is also applicable to a so-called horizontal-type cryopump, where the second cooling stage of the refrigerator is inserted and arranged in the (usually orthogonal) direction intersecting with the axial direction of the radiation shield 16.

The refrigerator 12 is a Gifford-McMahon refrigerator (so-called GM refrigerator). The refrigerator 12 is a two-stage refrigerator comprising a first stage cylinder 18, a second stage cylinder 20, a first cooling stage 22, a second cooling stage 24 and a refrigerator motor 26. The first stage cylinder 18 and the second stage cylinder 20 are connected in series, in which a first stage displacer and a second stage displacer (not illustrated), which are connected together, are respectively built in. A regenerator is incorporated into the first stage displacer and the second stage displacer. The refrigerator 12 may be one other than the two-stage GM refrigerator, for example, a pulse tube refrigerator may be used.

The refrigerator motor 26 is provided at one end of the first stage cylinder 18. The refrigerator motor 26 is provided inside a motor housing 27 formed at the end portion of the first stage cylinder 18. The refrigerator motor 26 is connected to the first stage displacer and the second stage displacer such that each of the first stage displacer and the second stage displacer can reciprocally move inside the first stage cylinder 18 and the second stage cylinder 20, respectively. The refrigerator motor 26 is connected to a movable valve (not illustrated) provided inside the motor housing 27 such that the valve can move in the forward direction and the reverse direction.

The first cooling stage 22 is provided at the end portion of the first stage cylinder 18 to the side of the second stage cylinder 20, i.e., at the connecting portion between the first stage cylinder 18 and the second stage cylinder 20. The second cooling stage 24 is provided at the terminal portion of the second stage cylinder 20. The first cooling stage 22 and the second cooling stage 24 are respectively fixed to the first stage cylinder 18 and the second stage cylinder 20 by, for example, brazing.

The compressor 40 is connected to the refrigerator 12 by a high pressure piping 42 and a low pressure piping 44. The refrigerator 12 expands within it an operating gas (e.g., helium) with a high pressure supplied from the compressor 40 so as to generate a cold state at the first cooling stage 22 and the second cooling stage 24. The compressor 40 recovers the operating gas expanded inside the refrigerator 12 and repressurize the gas to supply to the refrigerator 12.

Specifically, the operating gas with a high pressure is supplied to the refrigerator 12 from the compressor 40 through the high pressure piping 42. At the time, the refrigerator motor 26 drives the movable valve inside the motor housing 27 such that the high pressure piping 42 and the inside space of the refrigerator 12 are connected to each other. When the inside space of the refrigerator 12 is filled with the operating gas with a high pressure, the inside space of the refrigerator 12 is connected to the low pressure piping 44 with the refrigerator motor 26 switching the movable valve. Thereby, the operating gas is expanded and recovered into the compressor 40. Synchronized with the operation of the movable valve, the first stage displacer and the second stage displacer reciprocally move inside the first stage cylinder 18 and the second stage cylinder 20, respectively. By repeating such heat cycles, the refrigerator 12 generates cold states in the first cooling stage 22 and the second cooling stage 24. In the compressor 40, compression cycles in which the operating gas discharged from the refrigerator 12 is compressed to a high pressure and delivered into the refrigerator 12, are repeated.

The second cooling stage 24 is cooled to a temperature lower than that of the first cooling stage 22. The second cooling stage 24 is cooled to, for example, approximately 10 K to 20 K, while the first cooling stage is cooled to, for example, approximately 80 K to 100 K. A first temperature sensor 23 is mounted in the first cooling stage 22 in order to measure a temperature thereof, and a second temperature sensor 25 is mounted in the second cooling stage 24 in order to measure a temperature thereof.

The radiation shield 16, the first-stage panel 32, the second-stage cryopanel 14, and the first cooling stage 22 and the second cooling stage 24 of the refrigerator 12, are contained inside the pump case 34. The pump case 34 is formed by connecting in series two cylinders, diameters of which are different from each other. The end portion of the cylinder with a larger diameter of the pump case 34 is opened to form the cryopump opening 31, and a flange portion 36 for connection with the vacuum chamber 80 is formed extending outwardly in the radial direction. The pump case 34 and the radiation shield 16 are both formed into cylindrical shapes and arranged around the same axis. Because the inner diameter of the pump case 34 is slightly larger than the outer diameter of the radiation shield 16, the radiation shield 16 is arranged so as to be slightly spaced apart from the interior surface of the pump case 34. The end portion of the cylinder with a smaller diameter of the pump case 34 is fixed to the motor housing 27 of the refrigerator 12. The cryopump 10 is fixed to an evacuation opening of the vacuum chamber 80 in an airtight manner by the flange portion 36 of the pump case 34, allowing an airtight space integrated with the inside space of the vacuum chamber 80 to be formed.

The radiation shield 16 is fixed to the first cooling stage 22 of the refrigerator 12 in a thermally connected state, while the second-stage cryopanel 14 is connected to the second cooling stage 24 thereof in a thermally connected state. Thereby, the radiation shield 16 is cooled to a temperature substantially equal to that of the first cooling stage 22, while the second-stage cryopanel 14 is cooled to a temperature substantially equal to that of the second cooling stage 24.

The radiation shield 16 is provided so as to protect the second-stage cryopanel 14 and the second cooling stage 24 from ambient radiation heat. The radiation shield 16 is formed into a cylindrical shape having the opening 31 at its one end. The shield opening 31 is defined by the interior surface at the end of the cylindrical side face of the radiation shield 16.

On the other hand, on the side opposite to the shield opening 31, i.e., at the other end of the radiation shield 16 to the pump bottom, an occluded portion 28 is formed. The occluded portion 28 is formed by a flange portion extending inwardly in the radial direction at the end bottomed portion of the cylindrical side of the radiation shield 16. As the cryopump 10 illustrated in FIG. 1 is a vertical-type cryopump, the flange portion is mounted in the first cooling stage 22 of the refrigerator 12. Thereby, a cylindrically-shaped inside space 30 is formed within the radiation shield 16. The refrigerator 12 protrudes into the inside space 30 along the central axis of the radiation shield 16, and the second cooling stage 24 is inserted in the inside space 30.

In the case of a horizontal-type cryopump, the occluded portion 28 is usually occluded completely. The refrigerator 12 is arranged so as to protrude into the inside space 30 along the direction orthogonal to the central axis of the radiation shield 16 from the opening for attaching the refrigerator, formed on the side face of the radiation shield 16. The first cooling stage 22 of the refrigerator 12 is mounted in the opening for attaching the refrigerator in the radiation shield 16, while the second cooling stage 24 thereof is arranged in the inside space 30. In the second cooling stage 24, is mounted the second-stage cryopanel 14. Therefore, the second-stage cryopanel 14 is arranged in the inside space 30 of the radiation shield 16. Alternatively, the second-stage cryopanel 14 may be mounted in the second cooling stage 24 with an appropriately-shaped panel mounting member.

The radiation shield 16 may not be cylindrical in shape but may be a tube having a rectangular, elliptical, or any other cross section. Typically, the shape of the radiation shield 16 is analogous to the shape of the interior surface of the pump case 34. The radiation shield 16 may not be formed as a one-piece cylinder as illustrated. A plurality of parts may form a cylindrical shape as a whole. The plurality of parts may be provided so as to create a gap between the parts.

The second-stage cryopanel 14 comprises a plurality of cryopanels arranged in a direction from the shield opening 31 to the inside of the pump, i.e., along the gas inflow direction A. The plurality of cryopanels are arranged so as to be spaced from each other in the arrangement direction. The arrangement direction of the cryopanels coincides with the central axis direction of the radiation shield 16.

Each of the cryopanels has, for example, a shape of the side face of a circular truncated cone, a so-called umbrella-like shape. Each cryopanel is fixed to a panel mounting member 68 fixed to the second cooling stage 24. Each panel comprises a panel side extending from the panel mounting member 68 outwardly in the radial direction away from the opening 31. An absorbent is not provided on the surface facing to the shield opening 31 of each panel side surface, while an absorbent (not illustrated) such as activated carbon or the like is adhered to the back surface thereof. It is intended that the front surface of each panel functions as a condensation surface and the back surface thereof as an adsorption surface.

The panel mounting member 68 has a cylindrical shape, one end of which is occluded and the other end thereof is opened. The occluded end is fixed to the upper end of the second cooling stage 24 and extends toward the bottom portion of the radiation shield 16 such that the cylindrical side thereof surrounds the second cooling stage 24. A plurality of panels are fixed to the cylindrical side of the panel mounting member 68 so as to be spaced apart from each other.

The first-stage panel 32 is provided in the shield opening 31 of the radiation shield 16. The first-stage panel 32 is provided so as to be spaced apart from the second-stage cryopanel 14 in the central axis direction of the radiation shield 16. The first-stage panel 32 is fixed on the end portion of the radiation shield 16 towards the shield opening 31, and is cooled to a temperature substantially equal to that of the radiation shield 16. A gate valve (not-illustrated) is provided between the first-stage panel 32 and the vacuum chamber 80. The gate valve is, for example, closed when the cryopump 10 is regenerated and opened when the vacuum chamber 80 is evacuated by the cryopump 10.

The first-stage cryopanel structure 32 comprises an outer panel 50 and an inner panel 52. Each of the outer panel 50 and the inner panel 52 is a disk-shaped plate arranged in parallel with the shield opening 31. Each of the outer panel 50 and the inner panel 52 occupies the whole of the shield opening 31. The outer panel 50 and the inner panel 52 face each other by a gap between them. The outer panel 50 and the inner panel 52 are arranged adjacent to each other, along the central axis of the pump. The peripheral portions of the outer panel 50 and the inner panel 52 are fixed to the radiation shield 16. Many openings are formed in the outer panel 50 and the inner panel 52. A clearance between the outer panel 50 and the inner panel 52 is designed to be, for example, substantially equal to the diameter of the opening.

Figure 2:
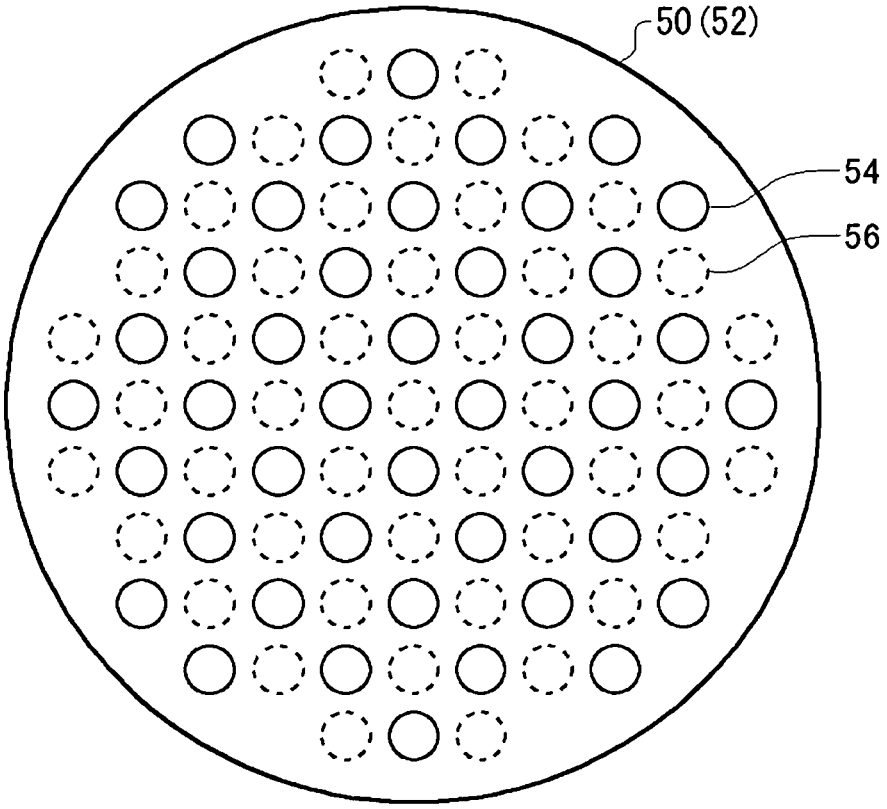
FIG. 2 is a schematic top view illustrating a first-stage cryopanel structure according to an embodiment.

FIG. 2 is a schematic top view illustrating the first-stage cryopanel structure 32 according to an embodiment. As illustrated in FIG. 2, many circular openings 54 are formed in the first distribution in the outer panel 50, while many circular openings 56 are formed in the second distribution in the inner panel 52. In FIG. 2 for convenience sake, the openings 54 of the outer panel 50, which are actually seen from top, are illustrated by solid lines, while the openings 56 of the inner panel 52, which are not seen by interrupting with the outer panel 50, are illustrated by dashed lines. Hereinafter, the openings 54 of the outer panel 50 are called first openings, while the openings 56 of the inner panel 52 called second openings.

The first openings 54 are formed in a uniform distribution in the outer panel 50, while the second openings 56 in a uniform distribution in the inner panel 52. When viewed from top, the first distribution and the second distribution are shifted from each other in the in-plane direction such that the second opening 56 is located between the adjacent first openings 54. Therefore, the panel surface of the inner panel 52 is arranged and exposed immediately beneath the first opening 54. Further, the panel surface of the outer panel 50 is arranged immediately above the second opening 56. Exposure of the inside of the cryopump (i.e., the second-stage cryopanel 14) to the outside is considerably limited by providing the first openings 54 and the second openings 56 alternately.

A plurality of second openings 56 (four openings in FIG. 2) are formed in the inner panel 52 so as to surround an inner panel portion located immediately beneath a single first openings 54. Likewise, a plurality of second openings 56 are formed in the inner panel 52 so as to surround the inner panel surface located immediately beneath another first opening 54 adjacent to a single first opening 54. Part of the plurality of second openings 56 corresponding to each of two adjacent first openings 54, are in common between the two. That is, a single second opening 56 is arranged so as to receive a gas flowing in through a plurality of first openings 54. Such an opening distribution increases the density of the openings on the panel.

The first opening distribution in the outer panel 50 and the second opening distribution in the inner panel 52 are set so as to satisfy, for example, required pumping performance (for example, required pumping speed) of the cryopump. Specifically, shape and size of the opening and the number thereof are adjusted in its design. For example, an opening distribution is set so as to satisfy the required pumping speed with respect to a gas (e.g., argon) to be pumped by the second-stage cryopanel 14. Because the first-stage cryopanel 32 has a relatively simple structure in which openings are formed in a flat plate, there is an advantage that the number of the openings and a diameter thereof can be flexibly and readily adjusted in its design so as to realize the required pumping performance, in comparison with another typical structure such as a louver, etc. Also, a change in the opening distribution can be readily made in terms of production.

A surface treatment for increasing the radiation factor, for example, a black-body treatment is applied to the inner panel 52 surface. With this, the radiation factor of the inner panel 52 surface is substantially equal to 1. The inner panel 52 is formed, for example, by applying black chromium plating on the surface of a copper substrate. Therefore, most of the radiation heat having passed through the first opening 54 of the outer panel 50 can be absorbed by the inner panel 52. Alternatively, for instance, black coating may be applied as the black-body treatment. The black-body treatment for the inner panel 52 may be applied only to the surface facing the outer panel 50 (i.e., top surface), or only to a portion (i.e., exposed region) of the top surface beneath the first opening 54. Alternatively, the black-body treatment may be applied to, for instance, the bottom surface of the outer panel 50 (i.e., surface facing the inner panel 52), instead of or in conjunction with the inner panel 52.

A surface treatment for lowering the radiation factor is applied to the outer panel 50. That is, a reflectance of the outer panel surface 50 is higher. The outer panel 50 is formed, for example, by applying nickel plating on the surface of a copper substrate. It may be possible that the radiation factor of the top surface (surface exposed to the outside) of the outer panel 50 is lowered, while that of the back surface (surface facing the inner panel 52) thereof is higher as stated above.

With this, among the radiation heat incident on the first-stage panel 32 from outside, the heat that reaches the outer panel 50 is reflected, while the heat that reaches the inside of the first-stage panel 32 is absorbed by a layer having a high radiation factor. Therefore, the first-stage panel 32 can effectively prevent the radiation heat from entering through the shield opening 31 into the pump inside.

At least one panel in the first-stage cryopanel structure 32 may have another appropriate structure, instead of a disk-shape having a circular opening as stated above. When viewed from the vacuum chamber 80, the at least one panel may have, for example, a concentric opening region distribution, or another opening region distribution such as a grid-like one. Alternatively, the at least one panel may have another structure having a louver or a chevron.

In operating the cryopump 10, the inside of the vacuum chamber 80 is evacuated to the degree of approximately 1 Pa by using other appropriate roughing pump prior to its operation. Subsequently the cryopump 10 is operated. The first cooling stage 22 and the second cooling stage 24 are cooled by driving the refrigerator 12, allowing the radiation shield 16, the first-stage panel 32 and the second-stage panel 14, which are thermally connected to the stages, also to be cooled.

The cooled first-stage panel 32 cools gas molecules traveling toward the inside of the cryopump 10 from the vacuum chamber 80, and condenses a gas (e.g., moisture), the vapor pressure of which is sufficiently low at the cooling temperature, on its surface to pump the gas. A gas, the vapor pressure of which is not sufficiently low at the cooling temperature of the first-stage panel 32, passes through the first-stage panel 32 and enters the inside of the radiation shield 16. Among the gas molecules having entered the inside, a gas, the vapor pressure of which is sufficiently low at the cooling temperature of the second-stage panel 14, is condensed on the surface of the second-stage panel 14 to be pumped. A gas, the vapor pressure of which is not sufficiently low at the cooling temperature, is adsorbed by an adsorbent, which is adhered to the surface of the second-stage panel 14 and cooled, and pumped. Thus, the cryopump 10 can enhance the degree of vacuum inside the vacuum chamber 80 to a required level.

Herein, dashed arrows in FIG. 1 illustrate typical traveling paths of gas molecules passing through the first-stage panel 32. As illustrated, the gas molecules linearly traveling toward the shield openings 31 from outside pass through the first opening 54 of the outer panel 50 to be reflected by the inner panel 52. The reflected gas molecules are further reflected by the bottom surface of the outer panel 50 to pass through the second opening 56 of the inner panel 52. Thus, the gas molecules that reach the inside of the radiation shield 16 are captured by the second-stage cryopanel 14. On the other hand, dashed-doted line in FIG. 1 illustrates an example of the radiation heat to enter the cryopump 10. As illustrated, the radiation heat having passed through the first opening 54 of the outer panel 50 is absorbed by the inner panel 52.

As stated above, according to the present embodiment, the gas molecules that have entered the inside of the first-stage panel 32 are guided to the inside of the cryopump after being reflected approximately two times. On the other hand, the radiation heat is reflected without entering the first-stage panel 32, or absorbed inside the first-stage panel 32. Therefore, it becomes possible that both a reduced influence of the radiation heat and an improved pumping speed of the cryopump are realized.

With the first-stage panel 32 having a double layer panel structure, a ratio of the opening region to the whole panel surface area can be higher in comparison with the case of a single layer panel. It is because entry of the radiation heat into the inside of the pump is considerably reduced in the double layer structure as stated above, in comparison with the case of the single layer panel where the radiation heat directly enters the inside thereof through the opening region. According to the present embodiment, both a reduced influence of the radiation heat and an improved pumping speed of the cryopump can be realized, which are in trade-off relationship with each other and are difficult to be attained at a time in the single layer panel.

Further, because the gas molecules are reflected several times by the first-stage panel 32, heat exchange between the gas molecules and the panel surface can be more facilitated. Thereby, the gas molecules to be captured by the first-stage panel 32 can be captured more effectively. In addition, the gas molecules to be captured by the second-stage panel 14 can also be cooled by the first-stage panel 32. Therefore, there is also an advantage that heat load on the second-stage panel 14 is further reduced in addition to the aforementioned reduction of the radiation heat.

As a result, it becomes easy to maintain the second-stage panel 14 at an evacuation operation temperature, allowing a gas adsorption amount of the second-stage panel 14 to be enhanced. Furthermore, because temperature controllability of the second-stage panel 14 is improved, revaporization of the captured gas, which possibly occurs during the evacuation operation, is suppressed, allowing high degree of vacuum to be stably realized.

Herein, the "top" and the "bottom" are used for convenience sake only to illustrate the positional relationships with the cryopump opening 31 in an understandable manner, and they are not intended to limit to upwards or downwards with respect to the vertical direction. That is, a state of being relatively close to the cryopump opening 31 is expressed by the "top", while that of being relatively remote from it is expressed by the "bottom", for convenience sake. Alternatively, it is only intended that a state of being relatively remote from the bottom of the pump is called the "top", while that of being relatively close to it is called the "bottom".

The present invention has been described above based on the embodiments. It should be appreciated by those skilled in the art that the invention is not limited to the above embodiments but various design changes and variations can be made, and such variations are also encompassed by the present invention.

At least one panel of the first-stage cryopanel structure 32 may be formed so as to have a structure in which the opening regions thereof are formed sparsely in a portion close to the second-stage cryopanel 14, while being formed densely in a portion remote therefrom. For example, in the case where the second-stage cryopanel 14 is arranged in the central portion of the cryopump, at least one of the outer panel 50 and the inner panel 52 may be formed such that density of the openings is sparse in the central portion thereof, while being dense in the peripheral portion thereof. With this, an ice layer can be more evenly accumulated on the whole second-stage cryopanel 14, avoiding the ice layer being accumulated on the top portion thereof in a concentrated manner. Therefore, the pumping capability of the second-stage cryopanel 14 can be totally and efficiently utilized, allowing a gas adsorption amount thereof to be enhanced.

In addition, a projected portion or a concave portion, which is used for guiding gas molecules having entered the inside of the first-stage cryopanel structure 32 to the outer panel 50, may be provided on the inner panel surface 52. For example, a conically-shaped projection may be provided in an exposed portion of the inner panel 52 immediately beneath the opening of the outer panel 50. By forming the conically-shaped projection so as to correspond to a diameter of the opening of the outer panel 50, i.e., forming it so as to have a diameter that is, for example, substantially equal thereto, the gas molecules traveling, for instance, vertically against the panel surface along the central axis of the pump can be reflected toward the back surface of the outer panel 50.

In addition, the shielding portion may be formed in the periphery of the opening region such that the radiation heat to enter the panel surface at a shallow angle is shielded. For example, a shielding member, which is arranged in a standing manner along the periphery of the opening of at least one of the outer panel 50 and the inner panel 52, may be provided. The shielding member is a short tubular member when the opening is circular. When the shielding member is provided in the outer panel 50, that may extend downwards from the periphery of the opening of the outer panel 50. On the other hand, when the shielding member is provided in the inner panel 52, that may extend upwards from the periphery of the opening of the inner panel 52. The shielding member may extend to, for example, approximately half the clearance between the outer panel 50 and the inner panel 52.

The first-stage cryopanel structure may include a third panel that absorbs or reflects the radiation heat, an angle between the central axis of the cryopump and the entering direction of which exceeds a predetermined angle, that is, the radiation heat that enters the panel surface at a shallow angle. The third panel may be provided more inside the pump than the first panel and the second panel. The third panel may be structured so as to guide the radiation heat having passed through the openings of the first and the second panels without being reflected by them, to a portion cooled to the first cooling temperature. The third panel may include a surface having an angle with the central axis of the cryopump such that the radiation heat linearly having passed through the openings of the first panel and the second panel is guided to the side surface of the radiation shield, and be arranged beneath the opening of the second panel. Further, the radiation factor of the third panel surface may be higher by, for example, the black-body treatment.

In addition, the clearance between the first-stage cryopanel structure and the second-stage cryopanel structure may be larger such that the radiation heat contactlessly and linearly having passed through the first-stage cryopanel structure is not incident on the second-stage cryopanel structure. For example, the clearance between the first-stage cryopanel structure and the second-stage cryopanel structure may be set such that the radiation heat linearly having passed through the opening regions of the first and the second panels of the first-stage cryopanel structure to the panel surfaces at a shallow angle, is incident on the shield side surface, without directly being incident on the second-stage cryopanel. Further, the clearance between the first and the second panels, and the opening shapes and opening distributions of the panels may be set so as to fulfill the aforementioned requirement.

As stated above, the whole of the radiation shield may be designed to have a double structure, instead of only the shield opening having a double structure. Alternatively, the side surface of the radiation shield may be designed to have a double structure. With this, the gas molecules having entered the outside of the radiation shield, i.e., the clearance between the radiation shield and the pump case, can be guided to the inside of the pump through the opening.

What is claimed is:

1. A cryopump comprising: a second-stage cryopanel; a radiation shield extending along a radiation shield axis and including a hollow tube-shaped wall extending along and about the radiation shield axis to surround the radiation shield axis and a bottom wall extending radially outwardly from the radiation shield axis at one end of the hollow tube-shaped wall and terminating at the hollow tube-shaped wall to form a container space, the hollow tube-shaped wall comprising a rim portion disposed opposite the bottom wall to define a radiation shield opening into the container space, the radiation shield opening and the container space being sized to receive the second-stage cryopanel with the second-stage cryopanel in contact with the bottom wall and disposed below the rim portion; and a first-stage cryopanel that is cooled to a temperature higher than that of the second-stage cryopanel and provided in the shield opening, which includes a first panel extending radially outwardly from the radiation shield axis and terminating at and directly contacting the rim portion of the hollow tube-shaped wall and provided with first openings extending through the first panel, and a second panel extending radially outwardly from the radiation shield axis and terminating at and directly contacting the rim portion of the hollow tube-shaped wall and provided with second openings extending through the second panel and disposed adjacent to yet disposed apart from the first panel in a parallel relationship, wherein the first openings facially oppose only the second panel without any one of the first openings facially opposing, in whole or in part, any one of the second openings and the second openings facially oppose only the first panel without any one of the second openings facially opposing, in whole or in part, any one of the first openings to thereby form a first offset arrangement of the first openings relative to the second openings and a second offset arrangement of the second openings relative to the first openings.

2. The cryopump according to claim 1, wherein the second openings of the second panel are formed so as not to overlap the first openings of the first panel, when viewed in an arrangement direction.

3. The cryopump according to claim 1, wherein a radiation factor of a front surface of the second panel is higher than that of the first panel.

4. The cryopump according to claim 1, wherein the front surface of the second panel is black.

5. The cryopump according to claim 1, wherein the first panel and the second panel are flat and are arranged in parallel with each other so as to cover the radiation shield opening.

6. The cryopump according to claim 1, wherein at least one of the first panel and the second panel is configured such that the openings in the at least one of the first panel and the second panel are formed sparsely in a portion close to the second-stage cryopanel and densely in a portion remote from the second-stage cryopanel.

7. A cryopump comprising: a second-stage cryopanel structure; a radiation shield extending along a radiation shield axis and including a hollow tube-shaped wall extending along and about the radiation shield axis to surround the radiation shield axis and a bottom wall extending radially outwardly from the radiation shield axis at one end of the hollow tube-shaped wall and terminating at the hollow tube-shaped wall to form a container space, the hollow tube-shaped wall comprising a rim portion disposed opposite the bottom wall to define a radiation shield opening into the container space, the radiation shield opening and the container space being sized to receive the second-stage cryopanel with the second-stage cryopanel in contact with the bottom wall and disposed below the rim portion; and a first-stage cryopanel structure that is cooled to a temperature higher than that of the second-stage cryopanel structure wherein the first-stage cryopanel structure includes a first panel extending radially outwardly from the radiation shield axis and terminating at and directly contacting the rim portion of the hollow tube-shaped wall and provided with first openings extending through the first panel and a second panel extending radially outwardly from the radiation shield axis and terminating at and directly contacting the rim portion of the hollow tube-shaped wall and provided with second openings extending through the second panel and disposed adjacent to yet disposed apart from the first panel in a parallel relationship, wherein the first openings facially oppose only the second panel without any one of the first openings facially opposing, in whole or in part, any one of the second openings and the second openings facially oppose only the first panel without any one of the second openings facially opposing, in whole or in part, any one of the first openings to thereby form a first offset arrangement of the first openings relative to the second openings and a second offset arrangement of the second openings relative to the first openings.

8. A cryopump comprising: a radiation shield forming a container space and extending along and about a radiation shield axis, the radiation shield including a hollow cylindrical wall extending along and about the radiation shield axis and a bottom wall extending radially outwardly from the radiation shield axis at one end of the hollow cylindrical wall and terminating as an integral construction with and at the hollow cylindrical wall, the hollow cylindrical wall comprising a rim portion disposed opposite the bottom wall and extending about the hollow cylindrical wall to define a radiation shield opening into the container space; a second-stage cryopanel disposed in the container space below the rim portion of the radiation shield and in contact with the bottom wall; and a first-stage cryopanel disposed in the container space at the rim portion of the radiation shield and including a flat first panel and a flat second panel disposed adjacent and parallel to yet spaced apart from the flat first panel, each one of the flat first and second panels extending radially outwardly from the radiation shield axis and terminating at and directly contacting the rim portion, the flat first panel having a first panel first flat surface, a first panel second flat surface extending parallel to and disposed apart from the first panel first flat surface to define a first panel thickness between the first panel first flat surface and the first panel second flat surface to define a first panel thickness direction extending parallel to the radiation shield axis and a plurality of first panel openings extending through and between the first panel first flat surface the first panel second flat surface and through the first panel thickness in the first panel thickness direction, the flat second panel having a second panel first flat surface, a second panel second flat surface extending parallel to and disposed apart from the second panel first flat surface to define a second panel thickness between the second panel first flat surface and the second panel second flat surface to define a second panel thickness direction extending parallel to the radiation shield axis and a plurality of second panel openings extending through and between the second panel first flat surface the second panel second flat surface and through the second panel thickness in the second panel thickness direction, wherein each one of the plurality of first panel openings facially opposes only the second panel first flat surface, without any one of the first panel openings facially opposing, in whole or in part, any one of the second panel openings, and each one of the plurality of second panel openings facially opposes only the first panel first flat surface, without any one of the second panel openings facially opposing, in whole or in part, any one of the first panel openings.

9. The cryopump according to claim 8, wherein the plurality of first panel openings facially opposes the second panel first flat surface without facially opposing, in whole or in part, any of the plurality of second panel openings, and the plurality of second panel openings facially opposes the first panel first flat surface without facially opposing, in whole or in part, any of the plurality of first panel openings to define an offset arrangement among the plurality of first panel openings relative to the plurality of second panel openings.

* * * * *